US006070327A

United States Patent [19]

Taso

[11] Patent Number: 6,070,327

[45] Date of Patent: Jun. 6, 2000

[54] MANUAL SHAVING APPARATUS

[76] Inventor: Selim Taso, 513 Heath St., Chestnut Hill, Mass. 02467

[21] Appl. No.: 09/253,033

[22] Filed: Feb. 19, 1999

[51] Int. Cl.[7] ..... B26B 21/40

[52] U.S. Cl. ..... 30/34.2; 30/537

[58] Field of Search ..... 30/34.2, 34.05, 30/537

[56] References Cited

U.S. PATENT DOCUMENTS 2,952,907 9/1960 Miller ..... 30/34.2

*Primary Examiner*—Douglas D. Watts

*Attorney, Agent, or Firm*—William Nitkin

[57] ABSTRACT

A shaving apparatus having a shaver head with a blade and a stretcher member, which stretcher member moves from a first position abutting the shaver head and blade in a direction opposite the direction of movement of the blade as the shaving apparatus is moved against the skin to stretch the skin. Such stretcher member can include mechanical movement structure including a pair of wheels moving a gear which, in turn, moves a rack member to advance such stretcher member to a second position away from the shaver head. In an alternate embodiment, the movement of the stretcher member can be accomplished by means of a motor and electric sensing means to direct the stretcher member to move when the shaver head moves against the skin.

5 Claims, 2 Drawing Sheets

MANUAL SHAVING APPARATUS

BACKGROUND OF THE INVENTION

1. Field of the Invention

The device of this invention resides in the area of shaving apparatuses and more particularly relates to a shaving apparatus with an improved skin-stretching mechanism to better cut hair protruding from the skin.

2. History of the Prior Art

Prior art shavers teach a variety of manual shaver heads having single and multiple blades. Such shavers have often included fin structures to stretch the skin so as to better cut the hair growing from the skin. Such stretching mechanisms in the prior art are disposed generally in advance of the movement of the blade such that they stretch the skin before the blade moves by and cuts the hair.

SUMMARY OF THE INVENTION

It is an object of this invention to provide an improved manual shaving apparatus with a skin-stretching mechanism which, contrary to the action of prior art devices, stretches the user's skin away from the direction of movement of the shaving apparatus to effect a generalized stretching of the skin. The action of the stretcher member is such that it pulls the skin away from the blade opposite the direction of movement of the blade of the shaving apparatus.

DESCRIPTION OF THE PREFERRED EMBODIMENT(S)

Figure 1:
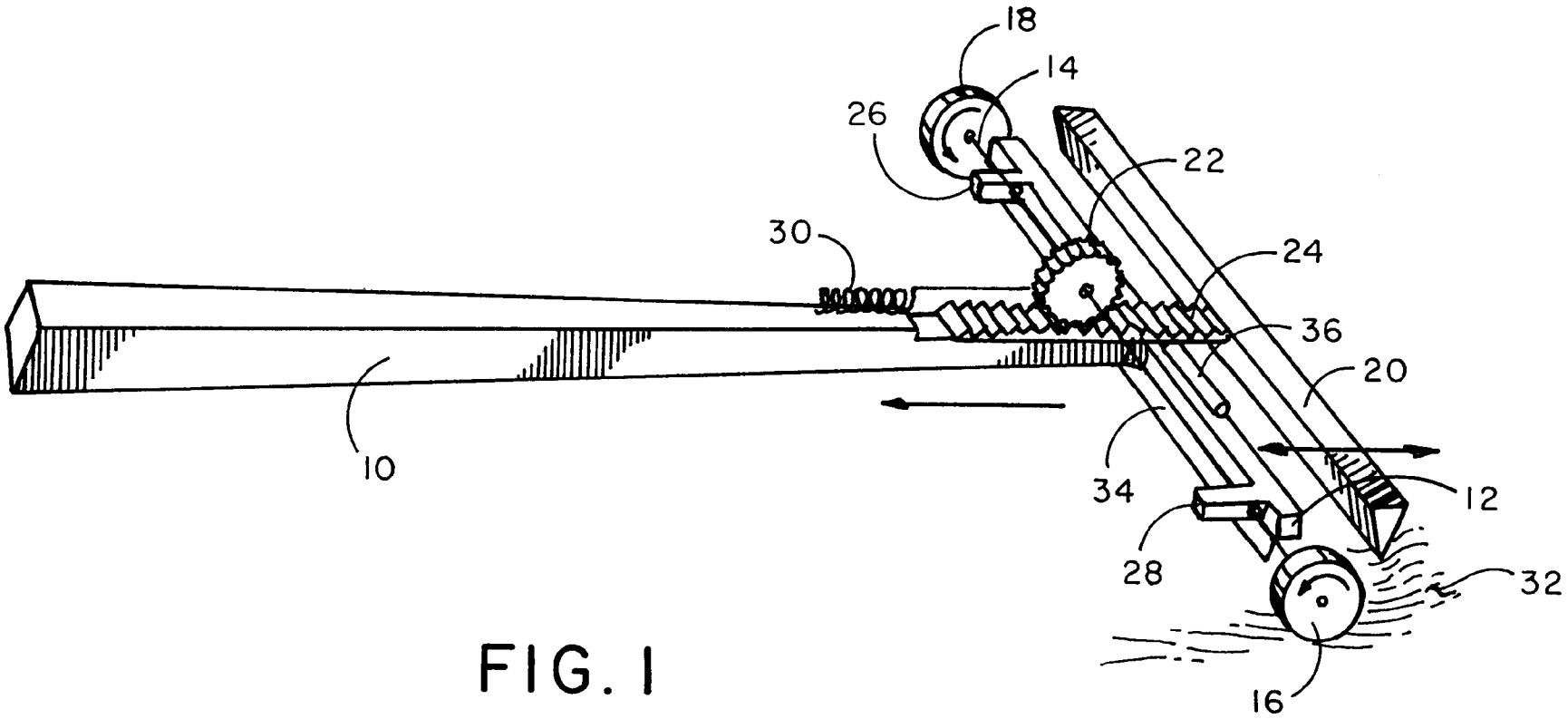
FIG. 1 illustrates a perspective view of the shaving apparatus of this invention using a mechanical skin stretching system.

The structure of the razor shaving apparatus of this invention is basically illustrated in FIG. 1 which shows a stylized shaver head 12 attached to a handle 10. It should be noted that shaver head 12 could be similar to any of the currently available disposable-type shavers made substantially of plastic, and its shape as shown in this drawing is merely as an example only as the shape could be of many different shaver head styles as used in the art including those shaver heads having multiple blades. Similarly the handle could have many different shape configurations. The concept of utilizing stretcher member 20 which is advanced away from the direction of the movement of the shaving stroke of shaver blade 34 is felt to be unique to the shaving apparatus of this invention. The shaving apparatus has at least one wheel, but in a preferred embodiment has a pair of wheels such as first wheel 16 and second wheel 18 which are attached to one another by shaft 14. Shaft 14 is rotatably held on shaver head 12 by support members 26 and 28 and also extends through, and is attached to, gear 22. As the shaving apparatus is moved along the skin with blade 34 cutting the hair, first and second wheels 16 and 18 rotate, caused by frictional contact with skin 32, in a counter clockwise direction, as indicated by the arrows thereon which in turn rotate gear 22. As gear 22 rotates, it advances rack member 24 which moves stretcher member 20 from a first position immediately in front of shaver head 12 to a second position disposed away from shaver head 12 to stretch skin 32 which is in contact therewith to aid in pulling the skin taut under blade 34. When one lifts the shaving apparatus off the skin, releasing the frictional retention of the skin on first and second wheels 16 and 18, spring 30 pulls rack member 24 rearwards and returns stretcher member 20 to its first position adjacent to shaver head 12 in ready position for the next stroke. If one does not wish to use the stretcher member feature of this invention for certain areas of the skin, a lock pin 36 can be advanced into rack member 24 to prevent its forward or rearward movement, thus making the shaving apparatus operate in the manner of prior art shavers.

Figure 2:
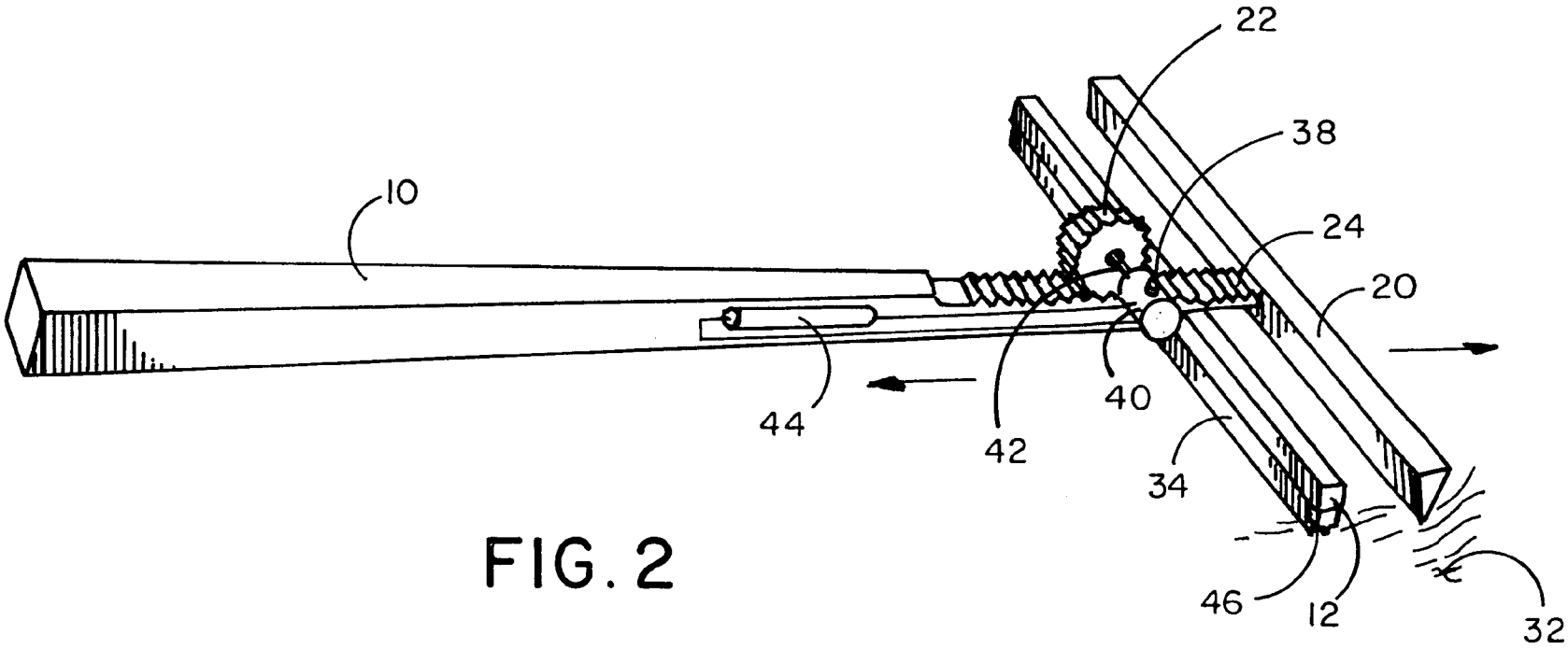
FIG. 2 illustrates a perspective view of the apparatus of this invention utilizing a motorized skin stretching system.

FIG. 2 illustrates an alternate embodiment of the shaving apparatus of this invention wherein stretcher member 20 is driven forward by a motor 40 to its second position, which motor is engaged by motor shaft 42 to gear 22 which, in turn, moves rack member 24 and attached stretcher member 20. A power source such as a rechargeable battery 44 can be located in handle 10 to power motor 40. An electric switch 46 acting as a sensor or similar mechanism can be positioned in shaver head 12 such that when pressure is applied to blade 34 or shaver head 12, electric switch 46 would be depressed and turned on, completing the circuit from battery 44 to motor 40, causing stretcher member 20 to move away from shaver head 12. Such electric switch 46 can connect the power source to power motor 40 on each shaving stroke. When the shaver head no longer contacts the skin, electric switch 46 is no longer depressed and turns off, causing the circuitry to reverse the direction of motor 40 and return stretcher member 20 to its first position against shaver head 12. In some cases the motor can continuously advance and automatically retract the rack member. An on/off switch 38 can be provided to shut off power to motor 40, when desired by the user, to render the stretcher member inoperative.

Although the present invention has been described with reference to particular embodiments, it will be apparent to those skilled in the art that variations and modifications can be substituted therefor without departing from the principles and spirit of the invention.

I claim:

1. An improved shaving apparatus for shaving hair on skin, said apparatus having a blade and a shaver head, said shaver head having a front side and an opposite side disposed toward its direction of travel during a shaving stroke, comprising:

a stretcher member disposed in a first position immediately in front of said shaver head, said stretcher member movable a distance in relation to the movement of said shaver head against said skin for stretching said skin away from the direction of movement of said blade to a second position during a shaving stroke.

2. The apparatus of claim 1 further including means to move said stretcher member that engages against said skin a distance from said shaver head.

3. An improved shaving apparatus for shaving hair on skin, said apparatus having a blade and a shaver head, said shaver head having a front side and an opposite side disposed toward its direction of travel during a shaving stroke, comprising:

a stretcher member disposed in a first position immediately in front of said shaver head, said stretcher member movable a distance in relation to the movement of said shaver head against said skin for stretching said skin away from the direction of movement of said blade to a second position during a shaving stroke;

means to move said stretcher member that engages against said skin a distance from said shaver head;

wherein said means to move said stretcher member further include:

at least one wheel disposed on said shaver head, said wheel frictionally engaged against said skin and rotatable when said shaving apparatus is moved during a shaving stroke against said skin;

a rack member attached to said stretcher member; and means to move said rack member, said means associated with the movement of said wheel such that said rack member is moved when said wheel rotates due to its frictional contact with said skin when said shaving apparatus is moved from said first position to said second position.

4. The apparatus of claim 3 further including:

a pair of wheels;

a shaft interconnecting said pair of wheels;

support means positioned on said shaver head for supporting said shaft;

a gear member mounted on said shaft and rotatable when said wheels rotate, said gear member engaging said rack member to advance said stretcher member in the opposite direction of movement of said shaving apparatus during said shaving stroke; and means to return said rack member and pull said stretcher member back to a first position adjacent to said shaver head at the end of said shaving stroke when said wheels are no longer frictionally engaged against said skin.

5. An improved shaving apparatus for shaving hair on skin, said apparatus having a blade and a shaver head, said shaver head having a front side and an opposite side disposed toward its direction of travel during a shaving stroke, comprising:

a stretcher member disposed in a first position immediately in front of said shaver head, said stretcher member movable a distance in relation to the movement of said shaver head against said skin for stretching said skin away from the direction of movement of said blade to a second position during a shaving stroke;

means to move said stretcher member that engages against said skin a distance from said shaver head, said means including:

an electric sensor to detect when said shaving apparatus is positioned on said skin;

a power source;

a motor;

a rack member attached to said stretcher member, said rack member movable by said motor;

means to interconnect said power source and said motor to drive said motor when said electric sensor indicates said shaving apparatus is in contact with said skin for driving said stretcher member forward from said first position to said second position; and means to return said stretcher member from said second position when said shaving apparatus is removed from contact with said skin to its first position immediately in front of said shaver head.

* * * * *